US010821498B2

(12) United States Patent
Kyttanen

(10) Patent No.: US 10,821,498 B2
(45) Date of Patent: Nov. 3, 2020

(54) CASTING PROCESS TO MAKE A METAL 3D PRODUCT

(71) Applicant: WHAT THE FUTURE VENTURE CAPITAL (WTFVC) B.V., Amsterdam (NL)

(72) Inventor: Janne Tuomas Kyttanen, West Hollywood, CA (US)

(73) Assignee: WHAT THE FUTURE VENTURE CAPITAL (WTFVC) B.V. (NL)

( * ) Notice: Subject to any disclaimer, the term of this patent is extended or adjusted under 35 U.S.C. 154(b) by 0 days.

(21) Appl. No.: 16/624,395

(22) PCT Filed: Jul. 4, 2018

(86) PCT No.: PCT/NL2018/050435
§ 371 (c)(1),
(2) Date: Dec. 19, 2019

(87) PCT Pub. No.: WO2019/009714
PCT Pub. Date: Jan. 10, 2019

(65) Prior Publication Data

US 2020/0122225 A1 Apr. 23, 2020

Related U.S. Application Data

(60) Provisional application No. 62/528,578, filed on Jul. 5, 2017.

(30) Foreign Application Priority Data

Aug. 8, 2017 (NL) ..... 2019403

(51) Int. Cl.
*B22C 9/04* (2006.01)
*B22C 7/02* (2006.01)

(52) U.S. Cl.
CPC ..... *B22C 9/04* (2013.01); *B22C 7/023* (2013.01)

(58) Field of Classification Search
CPC ..... B22C 7/02; B22C 7/023; B22C 7/026; B22C 9/04; B22C 9/043; B22C 9/046
See application file for complete search history.

(56) References Cited

U.S. PATENT DOCUMENTS 3,942,583 A * 3/1976 Baur ..... B29O 33/38 164/246
4,888,082 A * 12/1989 Fetcenko ..... B22C 7/026 156/500

FOREIGN PATENT DOCUMENTS

DE 102009033170 A1 1/2011
GB 999316 A 7/1965
(Continued)

OTHER PUBLICATIONS

International Search Report & Written Opinion for PCT/NL2018/050435; dated Oct. 26, 2018; 10 pgs.

*Primary Examiner* — Kevin E Yoon
(74) *Attorney, Agent, or Firm* — Gardner Groff & Greenwald, PC

(57) ABSTRACT

The invention is directed to a casting process to make a metal 3D product by performing the following steps, (a) providing a form negative mould of the 3D product comprising of a plastic sheet which sheet defines at its inner side a hollow space corresponding with at least the shape of one or more of the 3D products by thermoforming using a master mould, (b) applying a layer of refractory material on the exterior of the plastic sheet of the mould to obtain a ceramic mould having a hollow space, (c) pouring molten metal into the hollow space of the ceramic mould and allowing the
(Continued)

metal to solidify, and. (d) removing the layer of refractory material to obtain the metal 3D product.

9 Claims, 2 Drawing Sheets

(56) References Cited

FOREIGN PATENT DOCUMENTS

| | | | |
|---|---|---|---|
| JP | S60137546 | | 7/1985 |
| JP | H05038550 | | 2/1993 |
| JP | 05050179 A | * | 3/1993 |

* cited by examiner

CASTING PROCESS TO MAKE A METAL 3D PRODUCT

TECHNICAL FIELD

The invention is directed to a casting process to make a metal 3D product.

BACKGROUND

Casting is a manufacturing process in which a molten metal material is poured into a mould. The mould has a hollow cavity of the desired shape and the metal is allowed to solidify. The solidified 3D product may be broken out of the mould. Cold setting materials which cure after mixing of two or more components are also used instead of a molten metal. A casting process used on a commercial scale is the so-called investment casting. In this process a wax copy of the 3D product to be made is surrounded with a refractory material. A wax gating system is present which connects the wax copy with the exterior of the refractory material. The ceramic moulds thus obtained are cured and subjected to a burnout step. In this step the wax melts and/or vaporizes and is able to leave the ceramic mould via the gating system leaving a hollow space corresponding to the 3D product. Next molten metal is poured into the opening of the gating system such that the metal fills the hollow space corresponding to the 3D product. After the metal solidifies the ceramic shell is removed and the metal 3D product is obtained.

Such investment casting is a well-known process and has been used in various forms for the last 5000 years. A disadvantage of the known processes is that a wax copy of the 3D product has to be made. The wax copy is difficult to handle because it can be damaged before the wax copy is surrounded by the refractory material. Alternatives for wax have been proposed which are stronger. For example, polystyrene has been suggested as an alternative for wax. A problem with such a material is that the solid polystyrene copy of the 3D product expands when heated in the burnout step. The expanded polystyrene could damage the ceramic mould. In GB999316 of 1962 it is suggested to cover the polystyrene copy with a thin layer of wax. The wax would melt before the polystyrene such to leave a space in which the polystyrene can expand before it melts or combusts. Although polystyrene or other plastic materials have been suggested for some years it appears that wax is still the most used material in the casting processes.

JPS 60137546, DE102009033170 and JPH0538550 describe a casting process wherein a form mould is a formed plastic sheet. Such a form mould is stronger and less prone to damage as a wax copy. When products having changing designs have to be made in high numbers such processes are not preferred because they are laborious.

SUMMARY

The present inventions aims to provide a casting process which can manufacture different designed products in high numbers.

This object is achieved by the following process.

Casting process to make a metal 3D product by performing the following steps (a) providing a form negative mould of the 3D product comprising of a plastic sheet which sheet defines at its inner side a hollow space corresponding with at least the shape of one or more of the 3D products, by thermoforming using a master mould, (b) applying a layer of refractory material on the exterior of the plastic sheet of the mould to obtain a ceramic mould having a hollow space, (c) pouring molten metal into the hollow space of the ceramic mould and allowing the metal to solidify, and (d) removing the layer of refractory material to obtain the metal 3D product.

Applicants found that moulds may be obtained in a simple and fast method when such moulds are obtained by thermoforming. Thermoforming is a method known from the packaging industry and allows the manufacture of large numbers of moulds in a quick process.

In step (a) a form negative mould of the 3D product comprising of a plastic sheet is provided. This includes the use of already manufactured form negative moulds and the manufacture of such moulds. The mould is an object comprising of a plastic sheet which surrounds a hollow space at its inner side. The hollow space corresponds with at least the shape of one or more of the 3D products. In step (c) molten metal is poured into the hollow space. For allowing the metal to flow to the spaces corresponding to the 3D products it is preferred that the plastic sheet further defines a gating system. This gating system fluidly connects an opening into which molten metal may be poured in with the hollow spaces corresponding to the 3D products. The hollow space corresponding to the 3D products may be slightly smaller than the 3D products obtained in step (d). This difference in dimensions is caused by the dimensions of the plastic sheet. This plastic sheet will be removed prior to step (c) or in step (c). Thus the space occupied by the plastic sheet will also be filled with molten metal. Some metals may shrink slightly when solidifying. This difference may then be compensated.

The form negative mould of the 3D product is suitably comprised of at least two parts, also here referred to as shell parts, which are combined to obtain the mould. Complex designs of the 3D product to be made may require more than 2 shell parts. The use of 2 or more shell parts has been found advantageous because it simplifies the manufacture process of the mould.

The form negative mould of the 3D product comprises of a plastic sheet as obtained by thermoforming using a master mould which master mould. This master mould may be obtained by 3D printing or machined making use of for example computer numerical control. Preferably the master mould is obtained by 3D printing because this enables one to manufacture different designs without having to make master mould using laborious techniques like machining. A number of 3-D printing technologies will be available to the skilled addressee, printing in a range of materials including plaster (e.g. with the 3-D printer sold under the Registered Trademark "ProJet® 660 Pro" by 3D systems Inc., USA), thermoplastics, photopolymerised polymers, or thermally-sintered materials. In particularly preferred embodiments, the mould is produced using thermal sintering (preferably by laser) of materials such as that sold under the Registered Trademark Alumide®, and comprising a powdered composition of polyamide and powdered aluminium. The inventors have found that such a process and material produce a master mould that is particularly effective at resisting the temperatures applied in the thermoforming process.

When the master mould is made by 3D printing using a material having a low thermal conductivity as described above it is preferred that the master mould is provided with a number of openings which fluidly connect the side of the master mould facing the form negative mould of the 3D product and its opposite side. The thickness of the master mould is preferably between 0.5 and 5 mm. The holes are typically less than 2 mm in diameter, and preferably less than 1 mm in diameter. The openings allow air to escape through the master mould during the forming process. The master mould is further suitably provided with channels for passage of cooling air. Cooling of the master mould enhances the produced form negative mould of the 3D product to solidify into its desired shape in the master mould.

Thermoforming is a manufacturing process where a plastic sheet is heated to a pliable forming temperature and formed to a specific shape in a master mould. The sheet is heated to a high-enough temperature that permits it to be stretched into or onto a mould and cooled to a finished shape. The different shell parts of the form negative mould of the 3D product may be made using the same or different manufacturing processes as here described. Thermoforming is suitably performed using a thermoforming packaging machine. Thermoforming packaging machines are well known. Such machines enable one to prepare numerous moulds in a continuous process starting from a roll of sheet or from an extruder providing a sheet. Such a thermoforming packaging machine may comprise of one or two thermoforming stations, a sealing station and a cutting station. Preferably the thermoforming packaging machine comprises of one or two thermoforming stations, a sealing station and a cutting station and wherein the in a thermoforming station a formed intermediate sheet is obtained, wherein in the sealing station this formed intermediate sheet is combined with a planar sheet or with another formed intermediate sheet obtained in the optional second thermoforming station to obtained connected form negative moulds of the 3D product and wherein in the cutting station the form negative moulds of the 3D product are cut from the connected form negative moulds of the 3D product.

In the above thermoforming process a form negative mould of the 3D product is suitably made comprised of two formed plastic sheets or the mould is comprised of one formed plastic sheet and one planar sheet.

The plastic sheet may be any type of plastic and especially plastics suitable for injection moulding, vacuum forming or thermoforming. The material for the plastic sheet is preferably strong at a minimum sheet thickness. Furthermore, the plastic sheet should be easy to remove before or in step (c). The plastic is suitably a thermoplastic polymer. Examples of suitable thermoplastic polymers are polyethylene, polypropylene, polycarbonate and preferably polystyrene. The thickness of the sheet may vary from 50 microns to even 5 mm, wherein the lower part of the range may be used to make smaller products and the upper end of the range may be used to make larger products. For example, for making products having a maximum dimension of less than 50 cm the thickness of the sheet may vary between 50 and 200 microns.

In step (b) a layer of refractory material is applied on the exterior of the plastic sheet of the mould. This may be performed in the same manner as known for applying a layer of refractory around a wax copy as known from the prior art. In this step the ceramic mould may be produced by repeating a series of steps—coating, stuccoing, and hardening—until a desired thickness is achieved. Coating involves dipping the form negative mould of the 3D product into a slurry of fine refractory material and then draining to create a uniform surface coating. Fine materials are used in this first step, also called a prime coat, to preserve fine details as may be present at the exterior of the form negative mould of the 3D product. Examples of refractory materials are silica, zircon, various aluminium silicates such as mullite, and alumina. Zircon-based refractories may be used for the prime coat.

Prior to performing step (c) the form negative mould of the 3D product may be removed from the ceramic mould. This may be performed by heating the ceramic mould to a temperature wherein the plastic become fluid such that it can flow out of the ceramic mould via the gating system, for example under the influence of gravity. The plastic mould may also be removed by carbonization of the plastic mould, for example during the below described burn-out step. Because the plastic sheet material is relatively thin significantly less stress is expected when the form negative mould of the 3D product is removed at an elevated temperature.

Preferably the plastic form negative mould of the 3D product is removed from the ceramic mould by dissolving the plastic in a suitable solvent. The choice of a solvent will depend on the polymer used for the plastic form negative mould of the 3D product. Examples of such solvents, suitable in combination with for example polystyrene, are ketones, such as dimethylketon, methyl ethyl keton, methyl isobutyl keton optionally in combination with small amounts of a lower alcohol co-solvent. Examples of such lower alcohols are methanol, ethanol and propanol. The temperatures during dissolution of the plastic may be increased to above ambient to enhance the dissolution. Dissolving plastics may be performed according to well established methods as for example described in Beth A. Miller-Chou et al., A review of polymer dissolution, Prog. Polym. Sci. 28 (2003) 1223-1270.

The hollow space which remains in the ceramic mould is the space left by the thus removed form negative mould of the 3D product. The ceramic mould may then be subjected to a burnout step wherein the temperature is raised to between 850 and 1100° C. At these temperatures the plastic form negative mould of the 3D product, if still present, will typically be removed by carbonization of the plastic material. In an alternative process the plastic form negative mould of the 3D product is not removed and is as such present when molten metal is poured into the hollow space of the mould. The layer of the formed plastic sheet will then melt into the metal in step (c). When the volume of the plastic form negative mould of the 3D product is relatively small relative to the total volume of the 3D product relatively small amounts of plastic will melt into the metal. For some applications this may not be critical resulting in an even more simplified process.

In step (c) molten metal is poured into the hollow space of the ceramic mould. A gating system fluidly connects the opening in the ceramic mould with the hollow space in the ceramic mould in which the 3D product is formed. The metals may be those typically used in investment casting processes. Once the molten metal is poured into the hollow space it is allowed to solidify. Step (c) may be performed in any manner which is known for casting, for example it can also be performed as counter-gravity casting and vacuum casting.

BRIEF DESCRIPTION OF THE DRAWING FIGURES

DETAILED DESCRIPTION OF EXAMPLE EMBODIMENTS

Figure 1:
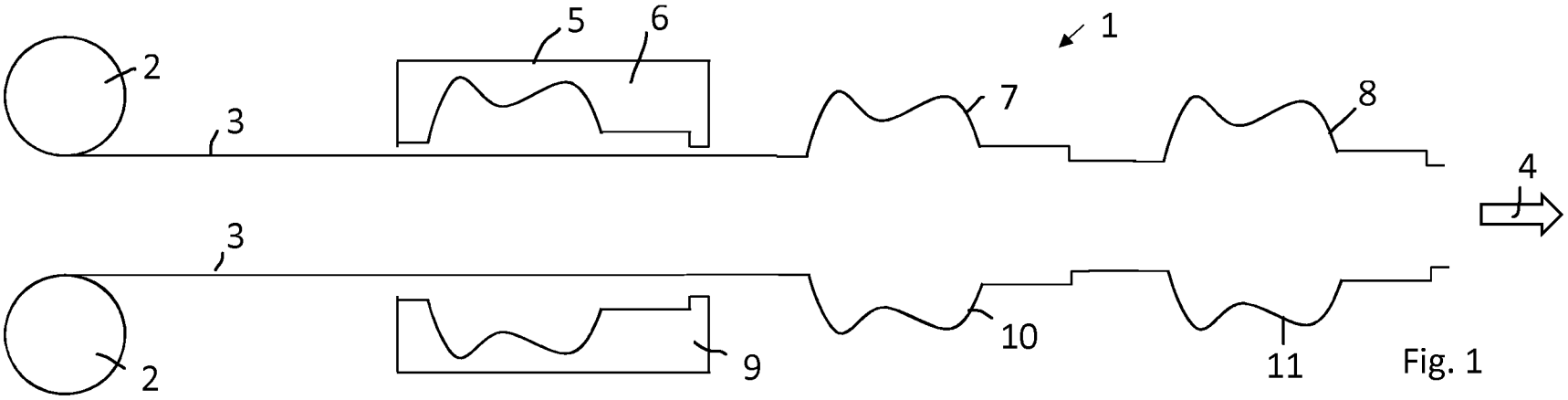
FIG. 1 shows a thermoforming packaging apparatus according to an example embodiment.

The invention shall be illustrated making use of the FIGS. 1-10. FIG. 1 shows a thermoforming packaging apparatus 1 having two rolls 2 of polystyrene sheet 3. The polystyrene sheets 3 travel in the direction of the arrow 4. At a forming station 5 an upper form negative mould (master mould) 6 of the 3D product forms the sheet 3 into a formed shell part 7,8. At a forming station 5 a lower form negative mould (master mould) 9 of the 3D product forms the sheet 3 into a formed shell part 10, 11.

Figure 2:
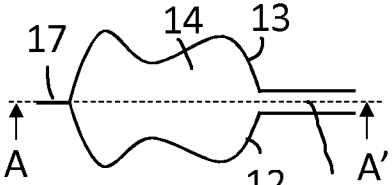
FIG. 2 shows a form negative mould of a 3D product according to an example embodiment.

At a downstream sealing and cutting station (not shown) shell part 8 is sealed to shell part 11 and cut off to obtain a form negative mould 12 of the 3D product as shown in FIG. 2. Subsequently shell part 7 is sealed to shell part 10 and also cut off to obtain a next form negative mould of the 3D product. This is repeated until a desired number of form negative moulds are obtained. The thus obtained form negative mould 12 is made up of a polystyrene sheet 13 and a hollow space 14 at its interior side. The hollow space 14 corresponds with the shape the 3D product 16 to be obtained. Also a gating system 15 is shown and a part 17 where the two sheets 3 are sealed.

Figure 3:
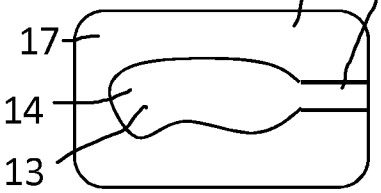
FIG. 3 shows the view AA' of FIG. 2.

FIG. 3 shows the view AA' of FIG. 2 where the reference numbers have the same meaning.

Figure 4:
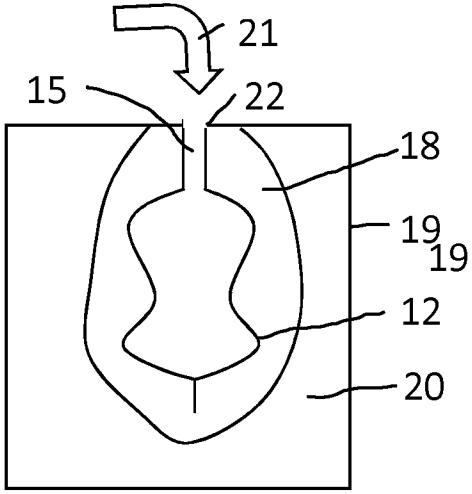
FIG. 4 shows a form negative mould with a layer of refractory placed in a tub filled with sand.

FIG. 4 shows form negative mould 12 with a layer of refractory 18 placed in a tub 19 filled with sand 20. Molten metal 21 may be poured into the opening 22 of gating system 15.

Figure 6:
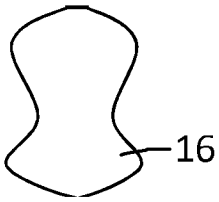
FIG. 6 shows a final metal 3D product according to an example embodiment.
Figure 5:
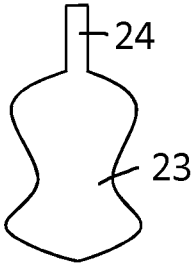
FIG. 5 shows an intermediate metal 3D product according to an example embodiment.

After the metal 21 solidifies and the refractory 18 is removed an intermediate metal 3D product 23 is obtained as shown in FIG. 5. After cutting away the metal part 24 as formed in the gating system 15 the final metal 3D product 16 is obtained as shown in FIG. 6.

Figure 7:
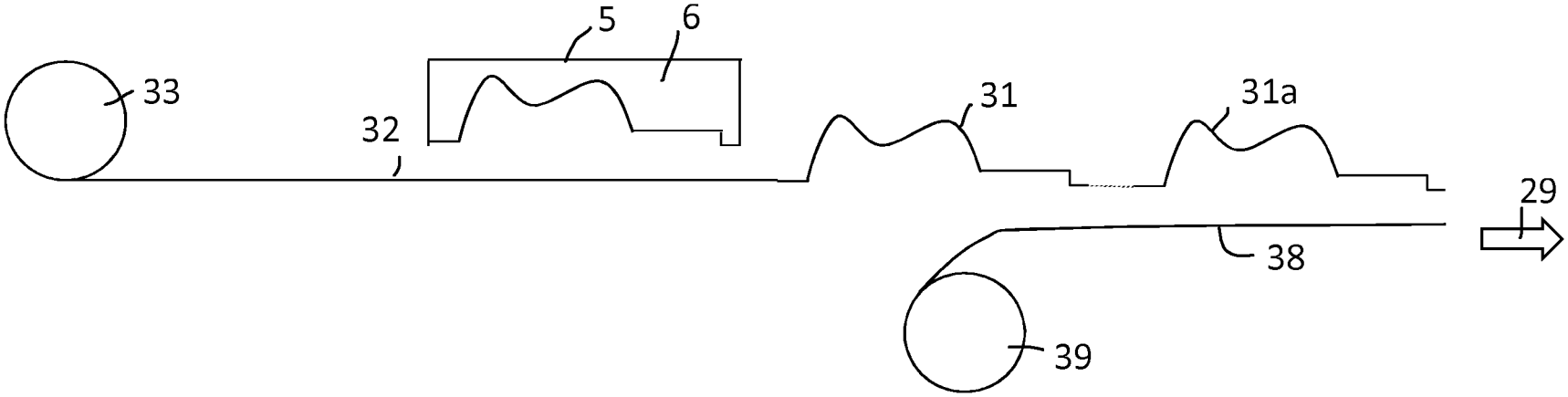
FIG. 7 shows a thermoforming apparatus according to another example embodiment.

FIG. 7 shows a thermoforming apparatus 30. In this process a formed shell part is combined with a planar shell part. The process runs in the direction of arrow 29. In this process a formed shell part 31 is obtained by thermoforming a sheet 32 of polystyrene drawn from roll 33 using master mould 6. This process is advantageous because it does not require to manufacture an upper and lower form negative (master) mould of FIG. 1. The formed shell part 31 is combined with a planar polystyrene sheet 38 as drawn from roll 39. At a downstream sealing and cutting station (not shown) shell part 31*a* is sealed to planar sheet 38 and cut off to obtain a form negative mould. Subsequently shell part 31 is combined with planar sheet 38 and also cut off to obtain a next form negative mould of the 3D product. The form negative moulds may be used as shown in FIGS. 4-6 to make a metal 3D product, i.e. a metal copy of the 3D object 34.

In FIG. 7 a continuous vacuum forming apparatus is illustrated. When only one or a small number of copies of the 3D object is desired one can make the formed shell part 31 on a piece by piece manner using for example a stand-alone vacuum table.

Figure 8:
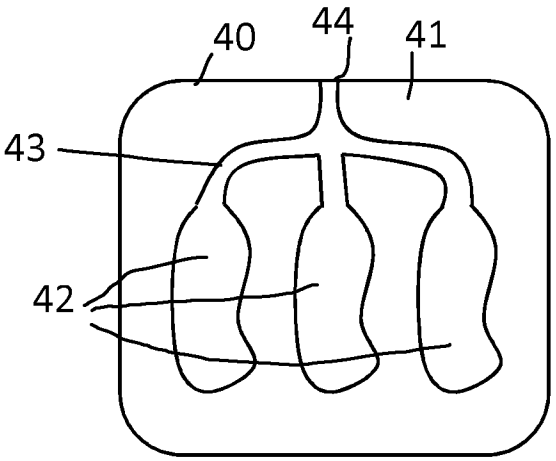
FIG. 8 shows a side view of a transparent form negative mould according to an example embodiment.

FIG. 8 shows a side view of a transparent form negative mould 40 having a plastic sheet 41 which defines at its inner side a hollow space 42 corresponding with the shape of three 3D products. The sheet 41 also defines a gating system 43 which allows molten metal to flow from opening 44 to all three hollow spaces 42. Such a mould 40 may be prepared by the apparatus of FIG. 1 or FIG. 7.

Figure 10:
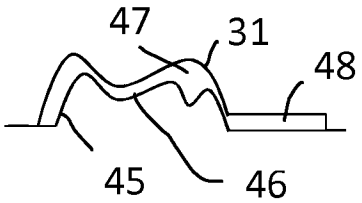
FIGS. 9 and 10 show how the formed shell part of FIG. 7 may also be combined with a second formed shell part to obtain a form negative mould of the 3D product.
Figure 9:
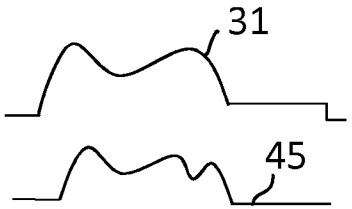

FIGS. 9 and 10 show how the formed shell part 31 of FIG. 7 may also be combined with a second formed shell part 45 to obtain a form negative mould of the 3D product 46. The inner side of this form negative mould 46 is a hollow space 48 corresponding with the shape of the final 3D product one wishes to obtain by the casting process. Second formed part 45 may be obtained in a continuous thermoforming packaging apparatus of FIG. 1. Also a gating system 48 is shown.

The invention claimed is:

1. Casting process to make a metal 3D product by performing the following steps (a) providing a form negative mould of the 3D product comprising of a plastic sheet which sheet defines at its inner side a hollow space corresponding with at least the shape of one or more of the 3D products, by thermoforming using a master mould, (b) applying a layer of refractory material on the exterior of the plastic sheet of the mould to obtain a ceramic mould having a hollow space, (c) pouring molten metal into the hollow space of the ceramic mould and allowing the metal to solidify, and (d) removing the layer of refractory material to obtain the metal 3D product, wherein the plastic sheet is a formed plastic sheet as obtained by thermoforming using a thermoforming packaging machine in a continuous process.

2. Process according to claim 1, wherein the plastic sheet further defines a gating system.

3. Process according to claim 1, wherein the mould is comprised of two formed plastic sheets or the mould is comprised of one formed plastic sheet and one planar sheet.

4. Process according to claim 3, wherein the thermoforming packaging machine comprises of one or two thermoforming stations, a sealing station and a cutting station and wherein the in a thermoforming station a formed intermediate sheet is obtained, wherein in the sealing station this formed intermediate sheet is combined with a planar sheet or with another formed intermediate sheet obtained in the optional second thermoforming station to obtained connected form negative moulds of the 3D product and wherein in the cutting station the form negative moulds of the 3D product are cut from the connected form negative moulds of the 3D product.

5. Process according to claim 1, wherein the master mould is obtained by 3D printing.

6. Process according to claim 1, wherein the plastic is a thermoplastic polymer.

7. Process according to claim 6, wherein the plastic is polystyrene.

8. Process according to claim 1, wherein the form negative mould of the 3D product is removed from the ceramic mould after performing step (b) by dissolving the plastic sheet in a solvent.

9. Process according to claim 1, wherein the form negative mould of the 3D product is removed from the ceramic mould after performing step (b) in a subsequent burnout step wherein the temperature is raised to between 850 and 1100° C.

* * * * *